US005391930A

United States Patent [19]

Ohshita et al.

[11] Patent Number: 5,391,930

[45] Date of Patent: Feb. 21, 1995

[54] CIRCUIT BREAKER WITH PARALLEL RESISTOR

[75] Inventors: Youichi Ohshita, Katsuta; Katuichi Kashimura, Takahagi; Akira Hashimoto, Hitachi; Osamu Koyanagi, Hitachi; Yukio Kurosawa, Hitachi; Isao Nishida, Hitachi, all of Japan

[73] Assignee: Hitachi, Ltd., Tokyo, Japan

[21] Appl. No.: 887,937

[22] Filed: May 26, 1992

[30] Foreign Application Priority Data

May 23, 1991 [JP] Japan ..... 3-146502

[51] Int. Cl.[6] ..... H01H 33/16

[52] U.S. Cl. ..... 307/98; 307/115; 200/144 AP; 361/10; 361/58

[58] Field of Search ..... 361/2, 3, 8, 9, 10, 361/58, 166; 307/96–99, 115, 113, 135; 200/144 AP

[56] References Cited

U.S. PATENT DOCUMENTS 3,538,277 11/1970 Phillips ..... 200/144 AP
3,796,891 3/1974 Kind et al. ..... 307/135
4,390,764 6/1983 Kriechbaum et al. ..... 200/144 AP
4,419,522 12/1983 Haginomori .
4,454,394 6/1984 Toyoda ..... 200/144 AP
4,617,435 10/1986 Kawasaki ..... 200/144 AP

FOREIGN PATENT DOCUMENTS 172409 2/1986 European Pat. Off. .
2827482 1/1980 Germany .

*Primary Examiner*—A. D. Pellinen
*Assistant Examiner*—Fritz M. Fleming
*Attorney, Agent, or Firm*—Antonelli, Terry, Stout & Kraus

[57] ABSTRACT

A circuit breaker with a parallel resistor which fulfills with a simple structure incompatible requirements for a resistance circuit making contact with regard to maintenance of the dielectric strength and prearcing characteristic between electrodes. A resistance circuit making contact 2 and a resistance circuit breaking contact 3 are electrically connected in parallel, one end of the parallel circuit is connected to one end of a common resistor and the other end of the parallel circuit and the other end of the resistor are connected to the respective ends of a main contact 1. After the opening of the resistance circuit making contact 2 the resistance circuit breaking contact 3 is still closed.

8 Claims, 3 Drawing Sheets

CIRCUIT BREAKER WITH PARALLEL RESISTOR

BACKGROUND OF THE INVENTION

1. Field of the Invention

The present invention relates to a circuit breaker with a parallel resistor and, in particular, relates to a circuit breaker with a parallel resistor which in the parallel resistor is used in common for a resistance circuit making contact and a resistance circuit breaking contact connected in parallel with respect to a main contact for reducing a switching surge or a transient recovery voltage during switching.

2. Description of Related Art

Circuit breakers with a parallel resistor, such as a gas circuit breaker with a circuit making resistor in which the circuit making resistor for suppressing a circuit making surge is connected in parallel with a main circuit breaking portion and an air circuit breaker with a circuit breaking resistor in which the circuit breaking resistor for reducing a transient recovery voltage rising rate during the current interruption is connected in parallel with a main circuit breaking portion, are generally known, and circuit breakers incorporating both the circuit making resistor and the circuit breaking resistor are comparatively a few.

However, in a power transmission system having a very high operating voltage such as UHV power transmission system of 1100 kV level, it is necessary to suppress the switching surge level at a low level for reducing the construction cost thereof and it is considered essential for gas circuit breakers used in such power transmission system to employ both the circuit making resistor and the circuit breaking resistor.

As one example of these types of circuit breakers, a structure of the circuit breaking portion is known as disclosed in JP(U)-A-57-185145(1982) of which an equivalent circuit is illustrated in FIG. 2. The circuit breaker is constituted by a main circuit breaking portion including a separable main contact 1, a resistance circuit making portion electrically connected in parallel with the main contact 1 and including an open and closeable resistance circuit making contact 2 and a circuit making resistor 4 and further a resistance circuit breaking portion electrically connected in parallel with the main contact 1 and including a separable resistance circuit breaking contact 3 and a circuit breaking resistor 5. Characteristics of the circuit breaker with regard to the opening and closing operation are shown in FIG. 3 wherein the characteristics of contact separating operations S1, S2 and S3 for the main contact 1, the resistance circuit making contact 2 and the resistance circuit breaking contact 3 are illustrated along with passage of time. In the circuit breaking operation "O", the resistance circuit making contact 2 begins to separate at time t1 prior to the separation of the main contact 1 at time t2, via the separation of the main contact 1 at time t2 the circuit breaking current is shifted to the circuit breaking resistor 5, at time t3 after several tens ms from the separation of the main contact 1 the resistance circuit breaking contact 3 is separated to undergo the current interruption at the resistance circuit breaking portion. Further, in the circuit making operation "C" (indicating "closing") at time t4 several tens ms prior to time t5 when the main contact 1 is made the resistance circuit making contact 2 is made to permit a predischarge current to flow through the circuit making resistor 4 and the resistance circuit breaking contact 3 is made at the same time t5 with the main contact 1 or at time t6 several tens ms thereafter.

Other than the above circuit breaker in which the main circuit breaking portion, the resistance circuit making portion and the resistance circuit breaking portion are separately constituted, JP-A-56-11816(1981) discloses a circuit breaker in which the resistance circuit making portion is constituted so as to serve as the resistance circuit breaking portion of which equivalent circuit is illustrated in FIG. 4, wherein in electrically parallel with the main contact 1 a series connection of a resistance contact 6 and a resistor 7 is connected and the opening and closing operation characteristics S1 and S6 of the both contacts 1 and 6 are illustrated in FIG. 5. Namely, in the circuit breaking operation "O"(indicating "opening"), after the main contact 1 is opened at time t2, at time t3 several tens ms thereafter the resistance contact 6 is opened to interrupt the current flowing through the resistor 7. On the other hand, in the circuit making operation "C"(indicating "closing"), at time t4 about 10 ms prior to time t5 when the main contact 1 closes, the circuit making contact 6 closes to insert previously the resistor 7 into the circuit. As a result, the resistor 7 and the resistance contact 6 perform both functions of the resistance circuit making portion and the resistance circuit breaking portion.

The conventional circuit breakers with a parallel resistor are constituted as explained above. Therefore in case of the circuit breaker as shown in FIG. 2, certain voltages appear at the terminals of the both resistors 4 and 5 on the sides of both contacts 2 and 3 when currents flow through the both resistors 4 and 5 and the insulation for the both voltages appearing at the terminals has to be maintained in such a manner that in the vicinity thereof conductors have to be disposed with predetermined spaced apart dielectric distances l1 and l2. These dielectric distances l1 and l2 for a high voltage circuit breaker reach upto several tens~several hundreds mm which causes a size increase of the circuit breaker. Further, during the circuit breaking operation "O", since the current interrupting capacity of the resistance circuit making contact 2 is low the resistance circuit making contact 2 has to be separated prior to the separation of the main contact 1, and the current to be interrupted has to be controlled to flow only through the main contact 1 and not through the resistance circuit making contact 2. For this reason the dielectric recovery voltage characteristics between the electrodes of the resistance circuit making contact 2 during its circuit opening operation always has to exceed those of the main contact 1. On the other hand, during the circuit making operation "C", a prior discharge always has to be caused at the resistance circuit making contact 2 to insert the resistor 4 into the circuit. The requirement during the circuit making operation "C" for the resistance circuit making contact 2 in which the electrode structure has to be designed likely to cause the prearcing is incompatible with the requirement during the circuit breaking operation "O" in which the electrode structure has to be designed to relax sufficiently the electric field caused thereby for obtaining a high dielectric recovery voltage characteristics between the electrodes. The same problem arises with respect to the circuit breaker shown in FIG. 4. Namely, the resistance contact 6 has to interrupt the current at the last time during the circuit breaking operation "O", therefore the electrode structure has to be designed to sufficiently relax the electric field therearound so as to withstand a high recovery voltage which will appear between the electrodes. On the other hand, the electrode structure during the circuit making operation "C" always has to be designed to initiate the prearcing and to insert the resistor 7 into the circuit, and the circuit breaker shown in FIG. 4 likely has to fulfill the incompatible two requirements.

SUMMARY OF THE INVENTION

An object of the present invention is to provide a circuit breaker with a parallel resistor which fulfills the above incompatible requirements with regard to the maintenance of the dielectric strength between the electrodes and the prearcing requirement with a simple constitution.

For achieving the above object, a circuit breaker with a parallel resistor according to the present invention wherein a series connection of a resistor and a resistance circuit making contact is electrically connected in parallel with a main contact is characterized, in that a parallel contact circuit is constituted by connecting a resistance circuit breaking contact in parallel with the resistance circuit making contact, one end of the parallel contact circuit being connected to one end of the resistor and the other end of the parallel contact circuit and the other end of said resistor being connected to the respective ends of the main contact.

Since the circuit breaker with a parallel resistor according to the present invention is constituted as explained above, even when the resistance circuit making contact opens prior to the main contact and then the main contact opens, the series circuit composed of the resistor and the resistance circuit breaking contact which is electrically connected in parallel with the main circuit is still closed, a recovery voltage is not yet applied between the electrodes of the resistance circuit making contact so that it is unnecessary to design the electrode structure which causes a sufficiently relaxed electric field in order to achieve a high dielectric recovery voltage characteristic between the electrodes as required in the convention circuit breakers with a parallel resistor. Therefore it is satisfactory when the electrode structure of the circuit making contact is designed which surely causes a prearcing during the circuit making operation, in that no such incompatible requirements as in the conventional circuit breakers are presented, and the structure of the resistance circuit making contact is simplified.

DESCRIPTION OF THE PREFERRED EMBODIMENTS

Hereinbelow, embodiments of the present invention are explained with reference to the drawings.

Figure 7:
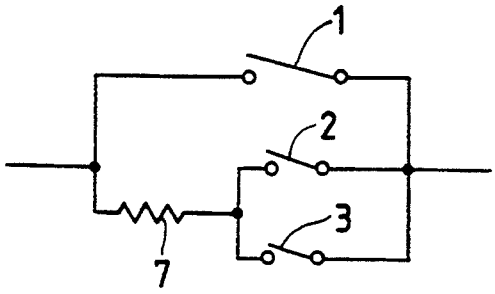
FIG. 7 is an equivalent circuit of the one embodiment of the circuit breakers with a parallel resistor according to the present invention shown in FIG. 1.

FIG. 7 shows an equivalent circuit of one embodiment of the circuit breakers with a parallel resistor according to the present invention. The resistance circuit making contact 2 and the resistance circuit breaking contact 3 are electrically connected in parallel so as to constitute a parallel contact circuit, to one end of the parallel circuit one end of the resistor 7 is electrically connected in series and the other end of the parallel circuit and the other end of the resistor 7 are connected to the respective ends of the main contact 1. Accordingly, the resistor 7 serves both as a resistor for the resistance circuit making portion and as a resistor for the resistance circuit breaking portion, on the other hand, the separate contacts therefor are respectively provided as the dedicated contacts.

Figure 2:
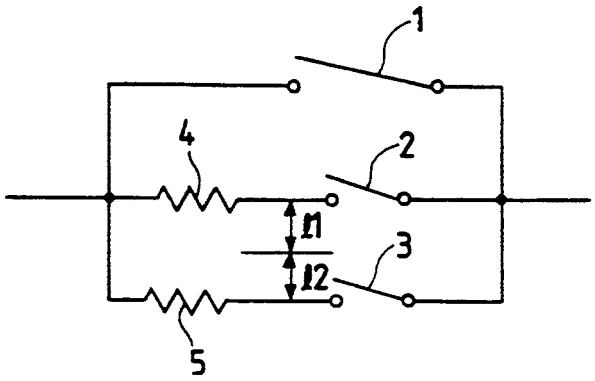
FIG. 2 PRIOR ART
FIG. 2 is an equivalent circuit of a coventional circuit breaker with a parallel resistor.
Figure 3:
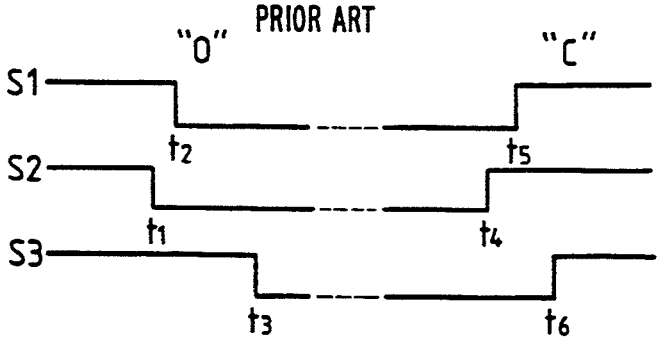
FIG. 3 PRIOR ART
FIG. 3 is operating characteristic diagrams of the respective contacts in the circuit breaker with a parallel resistor as shown in FIG. 2.
Figure 4:
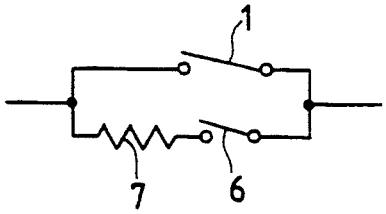
FIG. 4 PRIOR ART
FIG. 4 is an equivalent circuit of another conventional circuit breaker with a parallel resistor.
Figure 5:
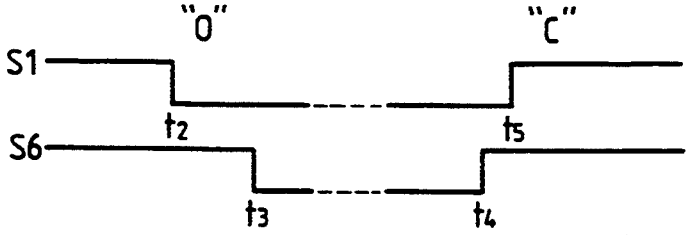
FIG. 5 PRIOR ART
FIG. 5 is operating characteristic diagrams of the respective contacts in the circuit breaker with a parallel resistor as shown in FIG. 4.

Now, considering the circuit breaking operation, the resistance circuit making contact 2 having a low current interrupting capacity is at first opened, then the main contact 1 opens, after the opening of the main contact 1, the current to be interrupted flows through the series circuit formed by the resistor 7 and the resistance circuit breaking contact 3. Accordingly, until this moment, no high recovery voltage is applied at the resistance circuit making contact 2, such that the conventional requirement for the resistance circuit making contact 2 that the dielectric recovery voltage characteristic between the electrodes thereof always has to be kept higher than that between the electrodes of the main contact 1 is unnecessitated, although a predetermined dielectric recovery voltage characteristic is required for the resistance circuit making contact 2 in relation to that of the resistance circuit breaking contact 3 which opens much later than the resistance circuit making contact 2. At this moment the resistance circuit making contact 2 is sufficiently opened such that the requirement for the dielectric recovery voltage characteristic therefor is easily fulfilled without using any special electrode structure. On the other hand, in the circuit making operation, the circuit making contact 2 is at first closed. However as explained above, since the electrode structure thereof is not required to be configurated to fully relax the electric field caused thereby, a prearcing is easily caused at the resistance circuit making contact 2 and the resistor 7 is inserted into the circuit to suppress a circuit making surge. Thereafter, the main contact 1 and the resistance circuit breaking contact 3 are closed in the same sequence as illustrated in FIG. 3. Although there are two contacts respectively for the resistance circuit making contact 2 and the resistance circuit breaking contact 3, one ends of the both contacts 2 and 3 are commonly connected to one end of the resistor 7, it is unnecessary to keep the dielectric distance l1 and l2 as illustrated in FIG. 2 even if the resistor 7 is constituted by a parallel connection of a plurality of resistors so that the entire size of the circuit breaker is reduced.

Figure 1:
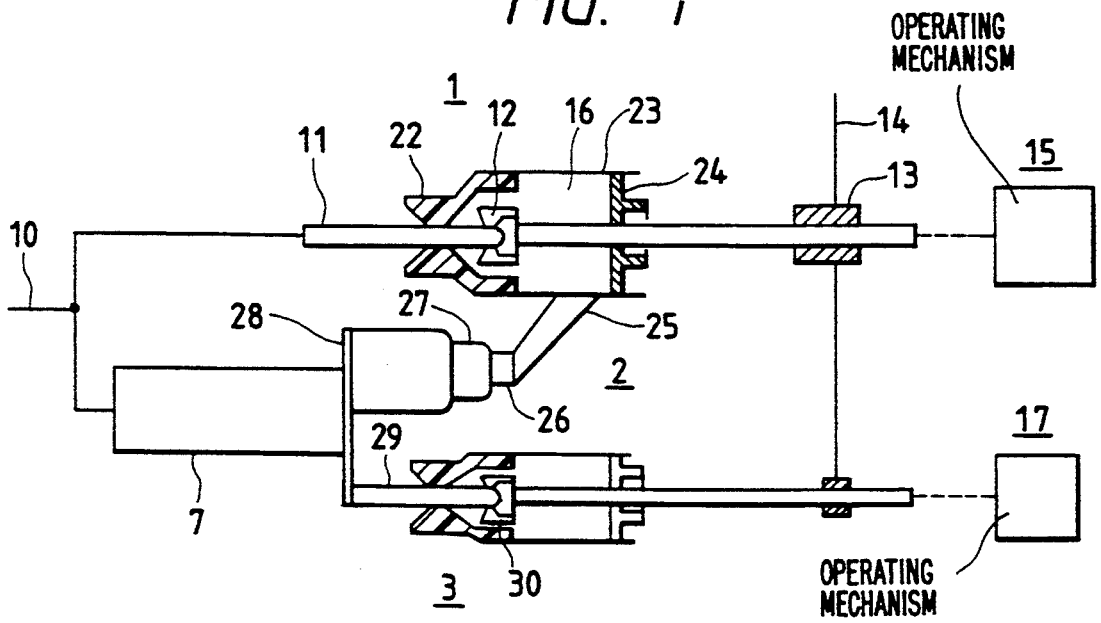
FIG. 1 is a partially cross sectioned schematic view of one embodiment of the circuit breakers with a parallel resistor according to the present invention.

A major part of a specific circuit breaker with a parallel resistor constituted according to the above explained equivalent circuit is shown in FIG. 1.

The main contact 1 is composed of a stationary electrode 11 and a movable electrode 12, the stationary electrode 11 is connected to one terminal 10 of a main circuit and the movable electrode 12 is connected to the other terminal 14 of the main circuit via a current collector 13. Further, to the movable electrode 12 an insulator nozzle 22 and a puffer cylinder 23 are coupled which are further coupled to an operating mechanism 15 for the main circuit breaking portion via an insulator rod of which illustration is omitted. The puffer cylinder 23 forms a puffer chamber 16 together with a piston 24, compresses an arc extinguishing gas in the puffer chamber 16 via the circuit breaking operation of the operating mechanism 15 for the main circuit breaking portion and blows the compressed gas toward an arc generated between the electrodes 11 and 12 in response to their opening via the guide of the insulator nozzle 22 to extinguish the same. As will be apparent from the above explanation, the main circuit breaking portion is constituted in a form of a so called puffer type circuit breaker.

To the puffer cylinder 23 a conductive supporting arm 25 is electrically and mechanically coupled, at the top end thereof a movable resistance circuit making contact 26 is secured, a follow-up type stationary resistance circuit making contact 27 is provided facing to the movable resistance circuit making contact 26 and the resistance circuit making contact 2 is constituted by the movable resistance circuit making contact 26 and the follow-up type stationary resistance circuit making contact 27. Since the follow-up type stationary resistance circuit making contact 27 is biased toward the right side via a spring and as well is provided with a dashpot mechanism which gradually releases the reaction force against the spring force, the resistance circuit making contact 2 opens prior to the opening of the main contact 1 during the circuit breaking operation by the operating mechanism 15 for the main circuit breaking portion and thereafter the follow-up type stationary resistance circuit making contact 27 projects to rightward via the action of the dashpot mechanism and the spring while being permitted an axially slidable follow-up movement toward the movable electrode thereof. As a result during the circuit making operation by the operating mechanism 15 for the main circuit breaking portion the resistance circuit making contact 2 closes prior to the closure of the main contact 1. The follow-up type stationary resistance circuit making contact 27 having such constitution is supported on a common conductive member 28 and one end of the resistor 7 is also supported and secured on the common conductive member 28. The resistor 7 is further supported by a suitable insulator member not shown, and the other end thereof is electrically connected to the one terminal 10.

Further, to the common conductive member 28 a stationary resistance circuit breaking contact 29 of the resistance circuit breaking contact 3 forming the resistance circuit breaking portion is electrically and mechanically coupled. A movable resistance circuit breaking contact 30 which is connected to the other terminal 14 is disposed facing to the stationary resistance circuit breaking contact 29 and the both contacts constitute the resistance circuit breaking portion in a form of a so called puffer type circuit breaker. The opening and closing operation of the resistance circuit breaking portion is carried out via an operating mechanism 17 for the resistance circuit breaking portion.

Thus the resistance circuit making contact 2 are electrically connected in parallel with the resistance circuit breaking contact 3, to one end of the parallel resistance contact circuit the resistor 7 is connected and the other end of the parallel resistance contact circuit and the other end of the resistor 7 are connected to the respective ends of the main contact 1.

For the circuit breaking operation, a circuit breaking command for the first time is generated from an external control unit and the operating mechanism 15 for the main circuit breaking portion is actuated and the movable electrode 12 of the main contact 1 is driven rightward in the drawing. When the movable electrode 12 moves by a predetermined distance, at first the resistance circuit making contact 2 opens and subsequently the main contact 1 is opened to generate an arc between the both electrodes 11 and 12 of the main contact 1. This is because the arc impedance is low in comparison with that of the resistor 7 connected in parallel. After about 0.5 cycle from the opening the gas pressure in the puffer chamber 16 is raised and the interrupting capacity between the electrodes is sufficiently enhanced so that the arc between the electrodes is extinguished at the following current zero point and the current is interrupted. The current interruption referred to in the above implies a current commutation to a circuit composed of the resistor 7 and the resistance circuit breaking contact 3 which is connected in parallel with the main contact 1. When a further predetermined time passes, the operating mechanism 17 for the resistance circuit breaking portion begins to actuate with a delay via an electrical or mechanical delay means, thereby the resistance circuit breaking contact 3 begins to open and an arc due to a resistance current limited by the resistor 7 is ignited between the both electrodes 29 and 30 of the resistance circuit breaking contact 3. The resistance current is finally interrupted and all of the contacts 1, 2 and 3 are rendered in the interrupting conditions thereby to complete the current interruption.

On the other hand, the circuit making operation is initiated by a generation of a circuit making command from an external control unit, and is carried out by driving the movable electrode 12 of the main contact 1 to leftward in the drawing via the operation of the operating mechanism 15 for the main circuit breaking portion. Because of the voltage applied between the electrodes 26 and 27 dielectric break down between the electrodes of the resistance circuit making contact 2 is for the first time caused and a current flows between the terminals 10 and 14 via the resistor 7. The resistance circuit making contact 2 closes while igniting the arc between the electrodes due to the resistance current and subsequently the main contact 1 closes. Namely, the resistor is short-circuited and all of the current is shifted to the main contact 1. When a further predetermined time passes, the operating mechanism 17 for the resistance circuit breaking portion begins to actuate with a predetermined delay via an electrical or mechanical delay means and the resistance circuit breaking contact 3 closes to complete all of the circuit making operations.

Figure 6:
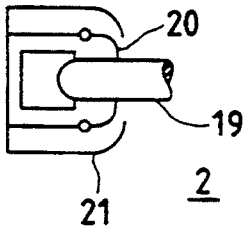
FIG. 6 is a cross section showing an embodiment of a major part of the circuit breakers with a parallel resistor according to the present invention.

As explained above, both during the current interrupting operation and the circuit making operation by causing the current to flow once through the resistor 7, the transient phenomena are relaxed and the switching surge is suppressed. Based on the above constitution, the control of the prior circuit making time is determined solely by the relative position of the resistance circuit making contact 2 with respect to the main contact 1 and no influences are received due to an operating characteristic fluctuation of the operating machanism 15 for the main circuit breaking portion caused by such as variation of operating fluid pressure and friction of the movable parts. Further, in the conventional circuit breakers, the resistance circuit making contact 2 always has to be opened prior to the opening of the main contact 1 during the circuit breaking operation and the dielectric recovery voltage characteristic of the resistance circuit making contact 2 has to always exceed the dielectric recovery voltage characteristic of the main contact 1. However, such requirements do not need to be fulfilled according to the present embodiment. Namely, during the current interruption, the resistance circuit breaking contact 3 connected in parallel with the resistance circuit making contact 2 is kept in the closed condition, no recovery voltage is applied at the resistance circuit making contact 2 and all of the current flowing through the circuit for the resistor 7 flows through the resistance circuit breaking contact 3. The resistance circuit breaking contact 3 has a capacity to interrupt the resistance current therefore can interrupt the same after a predetermined time which remarkably facilitates designing of the electrode structure of the resistance circuit making contact 2, for example a resistance circuit making contact 2 having only a limited current flowing capacity may be constituted as shown in FIG. 6 by a rod like movable resistance circuit making contact 19, a tulip shaped stationary circuit making contact 20 and a simple shield 21 surrounding the contact 20 which enables to improve the reliability of the current flowing property of the resistance circuit making contact 2.

On the other hand, during the circuit making operation, since the resistance circuit making contact 2 is always closed prior to the closure of the resistance circuit breaking contact 3, the problems with regard to the dielectric strength between the electrodes and the pre arc generation at the resistance circuit breaking contact 3 are eliminated, only the problem with regard to the current interrupting capacity is required to be taken into account for the resistance circuit breaking contact 3 so that the design freedom thereof is remarkably increased.

Figure 8:
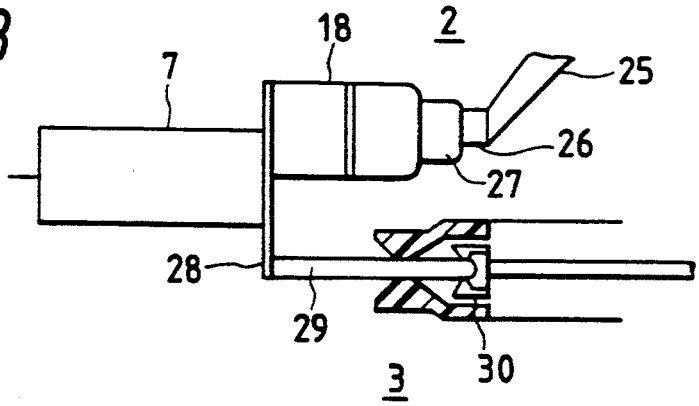
FIG. 8 is a partially cross sectioned schematic view showing another embodiment of a major part of the circuit breakers with a parallel resistor according to the present invention.

FIG. 8 is a partially cross sectioned schematic view showing another embodiment of a major part of the circuit breakers with a parallel resistor according to the present invention wherein the main contact as shown in FIG. 1 is omitted.

Like the previous embodiment, on the common conductive member 28 which is connected at one end of the resistor 7, the stationary resistance circuit making contact 27 constituting the resistance circuit making contact 2 of the resistance circuit making portion and the stationary resistance circuit breaking contact 29 constituting the resistance circuit breaking contact 3 of the resistance circuit breaking portion are supported and secured, but unlike the previous embodiment, a resistor 18 for adjustment use is disposed between the common conductive member 28 and the stationary resistance circuit making contact 27.

According to the present embodiment, the resistor 7 is served both as a resistor for the resistance circuit making portion and a resistor for the resistance circuit breaking portion so that substantially the same advantages can be obtained. Further, when it is required to use a resistor having a higher resistance value for the resistance circuit making portion than that for the resistance circuit breaking portion, such is simply fulfilled only by adding the resistor 18 for adjustment use between the common conductive member 28 and the stationary resistance circuit making contact 27 as shown in the drawing.

Figure 9:
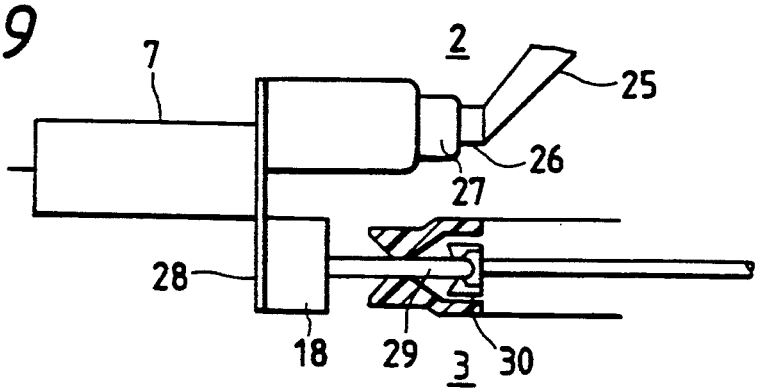
FIG. 9 is a partially cross sectioned schematic view showing a still further embodiment of a major part of the circuit breakers with a parallel resistor according to the present invention.

Contrary, a circuit breaker with a parallel resistor as shown in FIG. 9 shows a constitution wherein the resistance value of the resistance circuit breaking portion is larger than that of the resistance circuit making portion, such that the constitution of the resistance circuit making contact 2 is as same as that in the embodiment in FIG. l, on the other hand, the stationary resistance circuit breaking contact 29 constituting the resistance circuit breaking contact 3 of the resistance circuit breaking portion is supported and secured to the common conductive member 28 via the resistor 18 for adjustment use. As will be seen, when it is required to use a resistor having a higher resistance for the resistance circuit breaking portion than that for the resistance circuit making portion, such is simply fulfilled only by disposing the resistor 18 for adjustment use between the common conductive member 28 and the stationary resistance circuit breaking contact 29.

Figure 10:
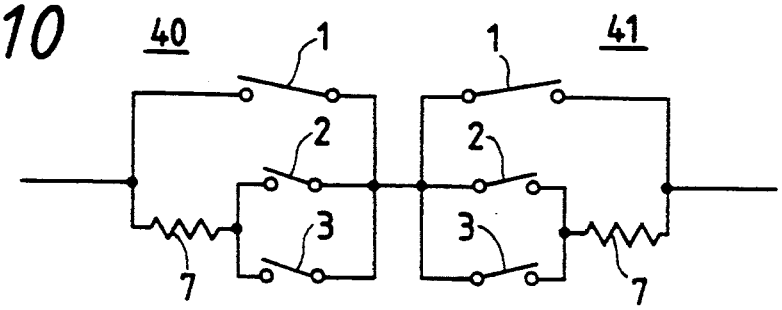
FIG. 10 is an equivalent circuit of a still further embodiment of the circuit breakers with a parallel resistor according to the present invention.

FIG. 10 is an equivalent circuit showing a still further embodiment of the circuit breakers with a parallel resistor.

A circuit breaker used in a high voltage system is composed by connecting electrically a plurality of circuit breaking units in series, in the same manner, in the present embodiment a circuit breaker with a parallel resistor and with two circuit breaking and making points is constituted by connecting in series two circuit breaking units 40 and 41 as explained in connection with FIG. 1 and FIG. 7 through FIG. 9. When the contacts at the movable side of the respective contacts 1, 2 and 3 are arranged to face each other as illustrated, the respective contacts, for example two main contacts 1 can be opened and closed with a common operating mechanism for the main circuit breaking portion.

Further, in the above embodiments, in particular as illustrated in FIG. 1 the resistance circuit making contact 2 in the resistance circuit making portion is opened and closed via the operating mechanism 15 for the main circuit breaking portion which is for opening and closing the main contact 1 in the main circuit breaking portion such that only two operating mechanisms in total are required thereby the structure of the circuit breaker is simplified, however, an operating mechanism may be provided for every contact.

As explained above, in the present invention, a parallel contact circuit is constituted by electrically connecting a resistance circuit making contact in parallel with a resistance circuit breaking contact, one end of the parallel contact circuit is connected to one end of a common resistor and the other end of the parallel contact circuit and the other end of the resistor are connected to the respective ends of a main contact, thereby even when the resistance circuit making contact is at first opened and then the main contact is opened, a series circuit composed by the resistor and the resistance circuit breaking contact which is connected in parallel with the main contact is still closed and no recovery voltage is yet applied between the electrodes of the resistance circuit making contact so that it is unnecessary to design the electrode structure to sufficiently relax the electric field caused thereby in order to achieve a high dielectric recovery voltage characteristic between the electrodes as required for the conventional resistance circuit making contact. For this reason, it is satisfactory if the electrode structure is designed to surely cause a prearcing during the circuit making operation and the conventional requirement of the incompatible characteristics is eliminated, accordingly a circuit breaker with a parallel resistor having a simple structured resistance circuit making contact is obtained.

We claim:

1. A circuit breaker comprising:

a main contact;

a resistance circuit making contact electrically dedicated to circuit making;

a resistance circuit breaking contact electrically dedicated to circuit breaking and being different from said resistance circuit making contact;

a main contact operating mechanism for opening and closing said main contact;

a circuit making operating mechanism for opening and closing said resistance circuit making contact, said circuit making operating mechanism opening said resistance circuit making contact predetermined amounts of time prior to openings of said main contact and said resistance circuit breaking contact during a circuit breaking operation, and closing said resistance circuit making contact predetermined amounts of time prior to closings of said main contact and said resistance circuit breaking contact during a circuit making operation;

a circuit breaking operating mechanism for opening and closing said resistance circuit breaking contact, said circuit breaking operating mechanism opening said resistance circuit breaking contact predetermined amounts of time after openings of said resistance circuit making contact and said main contact during said circuit breaking operation, and closing said resistance circuit breaking contact predetermined amounts of time after a closing of said resistance circuit making contact and said main contact during said circuit making operation; and a contact making/breaking resistor electrically connected in parallel, and at a first resistor end, with a main contact circuit, and commonly connected at a second resistor end with both said resistance circuit making contact and said resistance circuit breaking contact, such that said contact making/breaking resistor is a contact making resistor for said resistance circuit making contact during said circuit making operation and is a contact breaking resistor for said resistance circuit breaking contact during said circuit breaking operation.

2. A circuit breaker according to claim 1, wherein said main contact operating mechanism for said main contact also serves as said circuit making operating mechanism for said resistance circuit making contact, and a movable electrode of said main contact and a movable electrode of said resistance circuit making contact being mechanically and electrically coupled, and said opening and closing operation of said main contact and said resistance circuit making contact being performed via said main contact operating mechanism for said main contact.

3. A circuit breaker according to claim 2, wherein a stationary electrode of said resistance circuit making contact is constructed to permit an axially slidable follow-up movement toward a movable electrode thereof to provide said circuit making operating mechanism for opening and closing said resistance circuit making contact.

4. A circuit breaker according to claim 1, wherein a common conductive member is provided at said second resistor end of said contact making/breaking resistor, with a stationary electrode of said resistance circuit making contact and a stationary electrode of said resistance circuit breaking contact being secured at said common conductive member.

5. A circuit breaker as claimed in claim 1, wherein said resistance circuit making contact is provided with a resistor for adjustment of said contact making resistor.

6. A circuit breaker as claimed in claim 1, wherein said resistance circuit breaking contact is provided with a resistor for adjustment of said contact breaking resistor.

7. A circuit breaker comprising a plurality of circuit breaker units connected in series, wherein each circuit breaker unit comprising:

a main contact;

a resistance circuit making contact electrically dedicated to circuit making;

a resistance circuit breaking contact electrically dedicated to circuit breaking and being different from said resistance circuit making contact;

a main contact operating mechanism for opening and closing said main contact;

a circuit making operating mechanism for opening and closing said resistance circuit making contact, said circuit making operating mechanism opening said resistance circuit making contact predetermined amounts of time prior to openings of said main contact and said resistance circuit breaking contact during a circuit braking operation, and closing said resistance circuit making contact predetermined amounts of time prior to closings of said main contact and said resistance circuit breaking contact during a circuit making operation;

a circuit breaking operating mechanism for opening and closing said resistance circuit breaking contact, said circuit breaking operating mechanism opening said resistance circuit breaking contact predetermined amounts of time after openings of said resistance circuit making contact and said main contact during said circuit breaking operation, and closing said resistance circuit breaking contact predetermined amounts of time after a closing of said resistance circuit making contact and said main contact during said circuit making operation; and a contact making/breaking resistor electrically connected in parallel, and at a first resistor end, with a main contact circuit, and commonly connected at a second resistor end with both said resistance circuit making contact and said resistance circuit breaking contact, such that said contact making/breaking resistor is a contact making resistor for said resistance circuit making contact during said circuit making operation and is a contact breaking resistor for said resistance circuit breaking contact during said circuit breaking operation.

8. A circuit breaker comprising:

a main contact;

a resistance circuit making contact electrically dedicated to circuit making;

a resistance circuit breaking contact electrically dedicated to circuit breaking and being different from said resistance circuit making contact;

a main contact operating mechanism for opening and closing said main contact;

a circuit making operating mechanism mechanically coupled to said main contact operating mechanism and providing an opening and closing of said resistance circuit making contact in response to, and at an advanced time with respect to, an opening and closing of said main contact by said main contact operating mechanism, said circuit making operating mechanism opening said resistance circuit making contact predetermined amounts of time prior to openings of said main contact and said resistance circuit breaking contact during a circuit breaking operation, and closing said resistance circuit making contact predetermined amounts of time prior to closings of said main contact and said resistance circuit breaking contact during a circuit making operation;

a circuit breaking operating mechanism for opening and closing said resistance circuit breaking contact, said circuit breaking operating mechanism opening said resistance circuit breaking contact predetermined amounts of time after openings of said resistance circuit making contact and said main contact during said circuit breaking operation, and closing said resistance circuit breaking contact predetermined amounts of time after a closing of said resistance circuit making contact and said main contact during said circuit making operation; and a contact making/breaking resistor electrically connected in parallel, and at a first resistor end, with a main contact circuit, and commonly connected at a second resistor end with both said resistance circuit making contact and said resistance circuit breaking contact, such that said contact making/breaking resistor is a contact making resistor for said resistance circuit making contact during said circuit making operation and is a contact breaking resistor for said resistance circuit breaking contact during said circuit breaking operation.

* * * * *